United States Patent [19]

Corneille

[11] 4,436,651

[45] Mar. 13, 1984

[54] THERMIONIC CATHODE AND PROCESS FOR PREPARING THE SAME

[75] Inventor: David M. Corneille, c/o Cathodyne Corporation, 490 Windsor Park Dr., Centerville, Ohio 45459

[73] Assignee: David M. Corneille, Springboro, Ohio

[21] Appl. No.: 255,588

[22] Filed: Apr. 20, 1981

[51] Int. Cl.[3] ..... H01B 1/06

[52] U.S. Cl. ..... 252/521; 252/512; 252/513; 252/514; 313/346 R

[58] Field of Search ..... 313/346 R, 346 DC; 252/521, 518, 512, 513, 514; 29/25.11, 25.17, 25.18; 423/430, 432

[56] References Cited

U.S. PATENT DOCUMENTS

| | | | |
|---|---|---|---|
| 2,545,695 | 3/1951 | Hagelston et al. | 105/287 |
| 3,070,550 | 12/1962 | Aoi et al. | 252/521 |
| 3,541,661 | 5/1970 | Reaves | 313/346 |
| 3,656,020 | 4/1972 | Cronin | 313/346 |
| 3,760,218 | 9/1973 | Cronin | 313/346 R |
| 3,922,428 | 11/1975 | Cronin | 428/212 |

*Primary Examiner*—Josephine Barr

*Attorney, Agent, or Firm*—Biebel, French & Nauman

[57] ABSTRACT

A thermionic cathode is disclosed employing an alkaline earth metal hydroxy oxy carbonate as an emission material. Cathodes in accordance with the present invention are capable of operating in the range of 650° C. to 800° C. and can be formed by compressing a powdered mixture of the emission material and a metal.

16 Claims, 1 Drawing Figure

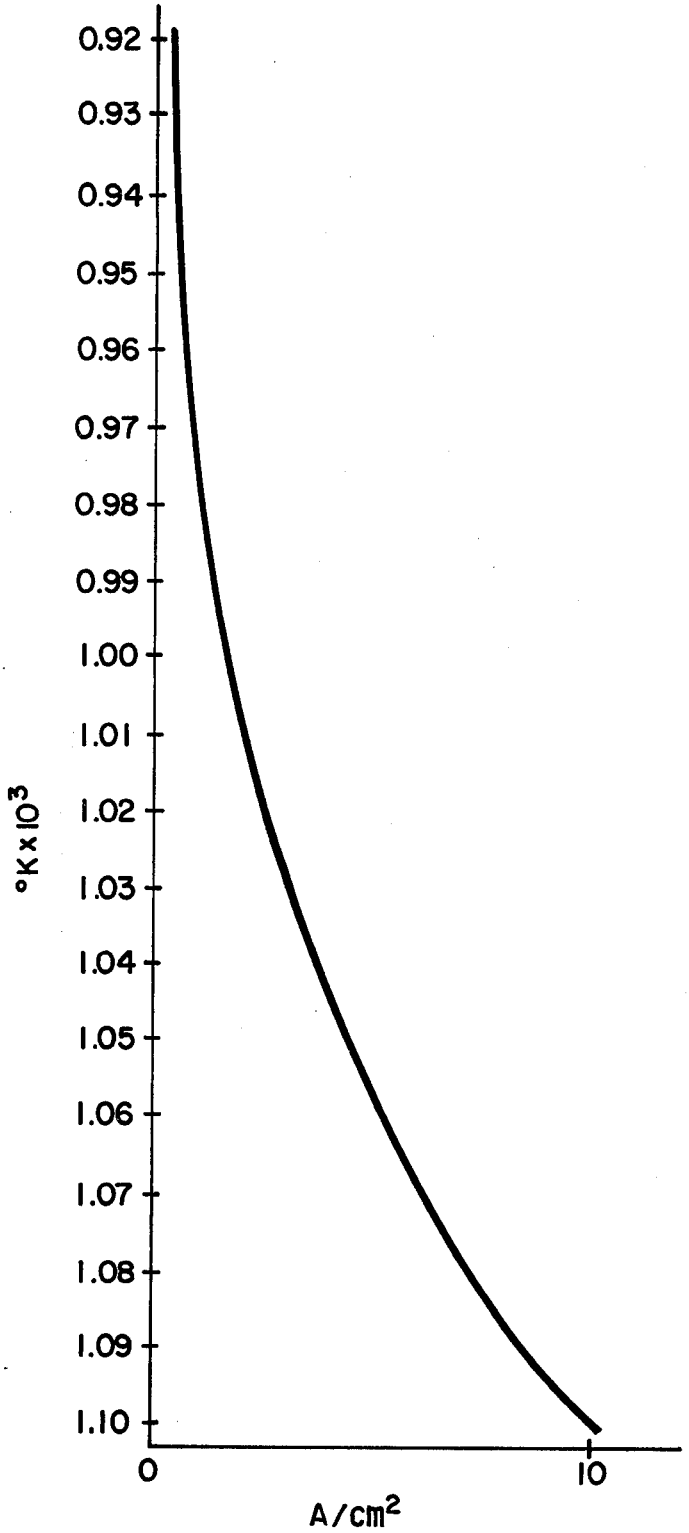
0.92
0.93
0.94
0.95
0.96
0.97
0.98
0.99
1.00
1.01
1.02
1.03
1.04
1.05
1.06
1.07
1.08
1.09
1.10
°K x 10³
0
10
A/cm²

THERMIONIC CATHODE AND PROCESS FOR PREPARING THE SAME

BACKGROUND OF THE INVENTION

The present invention relates to thermionic cathodes or so-called hot cathodes, and a process for preparing them. More particularly, it relates to a thermionic cathode formed using a novel emission material having a comparatively low operating temperature. The process of the present invention manufactures these cathodes without hot melting or machining.

Over the years thermionic cathodes have been made in various forms to achieve high current densities, low evaporation and long life. In one of its simplest forms, the cathode comprises an emission material sprayed or painted on the surfaces of a support member such as tungsten, nickel or molybdenum. Another generic group of cathodes is the dispenser cathodes in which the emission material is contained in an uniformly distributed throughout a porous body of tungsten. These cathodes are able to slowly dispense emission material through pores to the emission surface such that as the surface is depleted of emission material, it is replenished with material supplied from within the body of the cathode. Dispenser cathodes are typically manufactured by impregnating the pre-formed porous body of a refractory metal with a hot melt of the emission material.

The emission material most frequently used in the art is barium oxide. Barium oxide, however, is extremely hygroscopic and readily converts to barium hydroxide, which is more stable (less readily decomposed) and, therefore, less induced to emitting an electron. Barium oxide cathodes, therefore, must be handled and stored under a carefully maintained water free atmosphere. An alternative to barium oxide cathodes are barium carbonate cathodes which are not so reactive with moisture and will convert to barium oxide at elevated temperatures and release the desired electron emission.

Cronin has disclosed several examples of thermionic cathodes in U.S. Pat. Nos. 3,656,020; 3,760,218; and 3,922,428 in which in addition to barium oxide, the emission material includes a calcium oxide and lithium oxide (U.S. Pat. No. 3,656,020), one or more of cobalt oxide, manganese oxide and molybdenum oxide (U.S. Pat. No. 3,760,218), or samarium oxide (U.S. Pat. No. 3,922,428).

For conventional thermionic cathodes, the operating temperature is above 800° C. and in some cases as high as 1,000° to 1,150° C. Typically, the average current density of an oxide-type cathode is limited to 0.25 A/cm$^2$ at 800° C. Dispenser cathodes, on the other hand, which are fabricated by infiltrating a porous support with emission material, generally possess outputs ranging from 1 to 6 A/cm$^2$ average at temperatures of 1000° C. to 1150° C. High operating temperatures as well as complex machinery procedures have complicated the use and manufacture of thermionic cathodes and made them much more expensive. In particular, the cathode body or support, must be able to withstand the high temperatures. As a general rule, the cathode should not be operated at temperatures greater than half the melting point of the cathode body because the metal diffusion rates usually encountered at higher temperatures plug the pores of a dispenser-type cathode and terminate operation. As a result many conventional cathodes employ expensive and difficult to fabricate heat-resistant refractory metals to support the emission materials.

Thus, there is a need for thermionic cathodes which provide outputs comparable to conventional cathodes but at lower temperatures.

SUMMARY OF THE INVENTION

In view of the foregoing, a principal object of the present invention is to be provide a thermionic cathode having a high efficiency of electron emission at lower temperatures.

A related object of the present invention is to provide a novel emission material capable of operating at a comparatively low operating temperature, for example, on the order of 600° C. to 850° C.

Another object of the present invention is to provide a thermionic cathode which may be manufactured without hot melting and machining.

Still another object of the present invention is to provide an emission material which will tolerate hydrogen processing.

Another object is to provide a cathode that impervious to ion sputtering and which is operable in carbon monoxide and carbon dioxide lasers, as well as other gas-type lasers.

A further object of the present invention is to provide a method for manufacturing a thermionic cathode in which the cathode may be formed by simply compressing a powder mixture of the aforesaid emission material and a matrix-forming metal.

These and other objects of the present invention are attained using a novel emission material which is an alkaline metal hydroxy oxy carbonate. This material is capable of operating at a temperature in the range of 600° C. to 850° C. and higher and can be formed into a cathode by merely compressing it in a powdered mixture with a matrix metal.

BRIEF DESCRIPTION OF THE DRAWINGS

The present invention will be described below in detail by reference to the accompanying drawings in which:

The FIGURE is a graph of saturation current density and temperature for a Ba:Sr:Ca::50:30:20 cathode in accordance with the present invention.

DETAILED DESCRIPTION OF THE INVENTION

The cathode of the present invention is based on a novel emission material, which can operate at temperatures relatively much lower than emission materials previously used in the art. The FIGURE is a graph of saturation current density versus temperature for one such thermionic cathode of the present invention. The particular cathode is a 50:30:20 mix of barium, strontium and calcium compounds in a nickel matrix. Thermionic cathodes prepared in accordance with the present invention are able to deliver comparable outputs, i.e., about 1 to 6 A/cm$^2$ (average), in a temperature range from about 650° C. to 850° C. The emission material employed in the present invention is reponsible for the lower temperatures which are possible and represents a departure from the conventional thinking which considers alkaline earth metal hydroxides such as barium hydroxide unsatisfactory emission materials. This emission material of the present invention is an alkaline metal hydroxy oxy carbonate. As previously noted, in practice barium carbonate is used in place of barium oxide in cathodes due to the tendency of the oxide to react with moisture and yield the hydroxide. The hydroxide has a higher activation temperature and does not as easily decompose to the oxide to emit an electron. Thus, according to conventional thinking, barium hydroxide is not a desirable emission material. Similarly, U.S. Pat. No. 2,545,695 notes that one of the drawbacks of using barium peroxide as an emission material is its tendency to convert to the hydroxide and produce spotty break-down. As a result, barium peroxide cathodes require long aging before they are useful. The emission material of the present invention is believed to be a form of hydroxide, however, it is not only suitable but a preferred emission material.

In addition to the barium compound, the emission material of the present invention may be a compound from Group II A of the Periodic Table of Elements. The preferred compounds are the barium, strontium and calcium compounds or mixtures thereof. Some typical compositions in percent by weight are 50% barium-30% strontium and 20% calcium, 55% barium-30% strontium-15% calcium, 95% barium-5% calcium, 70% barium-20% strontium-10% calcium. By adjusting the metal composition of the emission material, the activity can be affected.

The emission material of the present invention is prepared by dissolving a salt of the metal(s) desired in an aqueous solution, neutralizing the solution with a base, driving the solution to a heavily basic condition using a compound such as hydrogen peroxide, and reacting the solution with carbon dioxide to precipitate the hydroxy oxy carbonate. In general, these reactions can be conducted at any concentration practical over a broad temperature range including room temperature. As a convenience to increase the yield, saturation concentrations are often employed. The only limit on the reaction temperature is the water itself meaning that temperatures from 0° C. to 100° C. are feasible.

The process for preparing the emission material together with the necessary conditions and parameters is described immediately below in more detail.

The metal salt used as a starting material may be any of the available salts of the alkaline earth metals including the hydroxides, carbonates, nitrates, halides, acetates, nitrites, oxides, permanganates, oxalates, etc. Preferably, the salt is water soluble, however, partially soluble or insoluble salts, may be used and driven into a solution by heat or acid. In fact, it has been found preferable to use an acid in the salt solution even if the salt is adequately soluble alone. The salt solution preferably has a pH less than about 5.8. Where an acid is used an acid is preferably selected having the salt's corresponding anion. This limits the different ions in the solution and helps make for cleaner reaction. The acid solution is generally filtered to remove impurities.

After dissolving the salt into solution, the solution is neutralized using a suitable basic salt. A typical salt that may be used is sodium hydroxide, but various other basic salts may also be used. The base is used in an amount sufficient to neutralize not only the metal salt but any anion acid added. Where, upon neutralization, there is precipitation from the solution, the precipitate may be removed or preferably additional water added to dissolve it. A basic salt is preferably selected which, in combination with the acid, yields a highly soluble salt pair such as sodium hydroxide and hydrochloric acid which yield sodium chloride. In this manner, the acid/base pair stays in solution and does not enter the reaction or precipitate with the reaction products.

A typical reaction thus far appears as:

$$BaCl_2+HCl+3NaOH \rightarrow 3NaCl+H_2O+Ba^{++}$$

The next step in the synthesis is to drive the system to a heavily basic state. A preferred pH is greater than about 11.2. This is typically done using hydrogen peroxide, however, in addition an excess of other basic salts such as the salts used in the foregoing neutralization step can also be used. Hydrogen peroxide is the preferred base because when added to the solution it generates the high pH without adding new metal ions to the system. This, again, makes for a cleaner reaction by limiting the free floating ions which may react or contaminate the product.

Upon the addition of hydrogen peroxide, the solution reacts with carbon dioxide. In most cases there is sufficient carbon dioxide in the air to conduct the reaction, however, the process may be speeded up by bubbling carbon dioxide through the reaction solution using a fritted glass tube or its equivalent. Upon reacting with carbon dioxide, a precipitate forms in the solution which is removed and used as the emission material of the present invention.

Some of the reaction schemes that can be used to obtain the emission material of the present invention are shown below. While more than one reactant is shown, the reactants can be used in the alternative. In the table X=alkaline earth metals, e.g., Ba, Sr or Ca.

$$XCl_2 + HCl + \begin{matrix} 3NH_4OH \\ 3NaOH \\ 3KOH \\ 3LiOH \end{matrix} + H_2O_2 + CO_2 \longrightarrow \text{Products}$$

$$X(NO_3)_2 + HNO_3 + \begin{matrix} 3NH_4OH \\ 3NaOH \\ 3KOH \\ 3LiOH \end{matrix} + H_2O_2 + CO_2 \longrightarrow \text{Products}$$

$$X(NO_2)_2 + HNO_3 + \begin{matrix} 3NH_4OH \\ 3NaOH \\ 3KOH \\ 3LiOH \end{matrix} + H_2O_2 + CO_2 \longrightarrow \text{Products}$$

$$XO + \begin{matrix} HCl \\ HNO_3 \\ H(C_2H_3O_2) \end{matrix} \begin{matrix} NH_4OH \\ NaOH \\ KOH \\ LiOH \end{matrix} + H_2O_2 + CO_2 \longrightarrow \text{Products}$$

$$X_3(PO_4)_2 + H_3PO_4 + \begin{matrix} 3NH_4OH \\ 3NaOH \\ 3KOH \\ 3LiOH \end{matrix} + H_2O_2 + CO_2 \longrightarrow \text{Products}$$

$$XOH + \begin{matrix} HClO_4 \\ HCl \\ HNO_3 \\ H(C_2H_3O_2) \end{matrix} + \begin{matrix} NH_4OH \\ 2NaOH \\ 2KOH \\ 2LiOH \end{matrix} + H_2O_2 + CO_2 \longrightarrow \text{Products}$$

$$X(C_2H_3O_2)_2 + H(C_2H_3O_2) + \begin{matrix} 3NH_4OH \\ 3NaOH \\ 3KOH \\ 3LiOH \end{matrix} + H_2O_2 + CO_2 \longrightarrow \text{Products}$$

$$X(C_6H_6COO)_2 + H(C_7H_6O_2) + \begin{matrix} 3NH_4OH \\ 3NaOH \\ 3KOH \\ 3LiOH \end{matrix} +$$

-continued $$H_2O_2 + CO_2 \longrightarrow \text{Products}$$

$$X(ClO_4)_2 + HClO_4 + \begin{matrix} 3NH_4OH \\ 3NaOH \\ 3KOH \\ 3LiOH \end{matrix} + H_2O_2 + CO_2 \longrightarrow \text{Products}$$

$$XBr_2 + HBr + \begin{matrix} 3NH_4OH \\ 3NaOH \\ 3KOH \\ 3LiOH \end{matrix} + H_2O_2 + CO_2 \longrightarrow \text{Products}$$

$$X(CN)_2 + HCN + \begin{matrix} NH_4OH \\ NaOH \\ KOH \\ LiOH \end{matrix} + H_2O_2 + CO_2 \longrightarrow \text{Products}$$

$$X_2Fe(CN)_6 + \begin{matrix} NH_4OH \\ NaOH \\ KOH \\ LiOH \end{matrix} + H_2O_2 + CO_2 \longrightarrow \text{Products}$$

$$X{-}(CO_3)_2 + \begin{matrix} HCO \\ HCL^3 \\ HNO \\ HCl \\ H(C_7H_6O_2) \\ H(C_2H_3O_2) \end{matrix} + \begin{matrix} NH_4OH \\ NaOH \\ KOH \\ LiOH \end{matrix} + H_2O_2 + CO_2 \longrightarrow \text{Products}$$

There are sufficient degrees of freedom in the above process with respect to its conditions that by adjusting the conditions the emission material can, within limits, be customized to provide emission properties as desired. The process is sufficiently flexible that it is possible to control the relative activity of the powder by affecting the particle's morphology, size and composition. The temperature of the reaction plays a particularly important role. The temperature affects the reaction rate, the degree of nucleation, which in turn influence the particle size and morphology of the precipitate. A broad range of temperatures may be used to produce the emission materials of the present invention and hence a range of emission characteristics are possible. Thus, a low activity powder can be fabricated for high temperature applications, e.g. 900° C. or above, where thermal evaporation may be a problem, as well as high activity powders for low temperature applications, e.g., 900° C. or below, where performance levels normally drop off. This also permits control over the particle size distribution of the powders produced. That is, the distribution can be limited to a very narrow range or expanded to a very broad range as desired. Depending on the conditions used, the powder may have a tetragonal crystal to a spherical crystal and range in size from 1 to 100 microns.

Thus, emission materials have a range of emission characteristics are possible in the present invention. By adjusting and controlling the conditions under which the materials are obtained an emission material having properties to specification can be reproducibly afforded.

The matrix metals used in the present invention are selected taking into consideration their expense, heat resistance and ductility for a particular application. The metals must be sufficiently ductile to form the cathode by the process described below. Because of the lower temperatures which are possible in accordance with the present invention, the cathodes can be manufactured without refractory materials such as tungsten and molybdenum and in many cases the expense of refractory materials may not be justified. Of course, there are emission materials made to operate at higher temperatures in the present invention. A preferred low temperature matrix material used in the present invention is nickel. Rhenium is expensive but may be preferred in higher temperature operations. Rhenium-tungsten-nickel alloy may also be preferred for some higher temperature applications. Other metals such as molybdenum, platinum, paladium, ruthenium, iron, tantalum can also be used.

Instead of starting with a metal powder to form the matrix metal, it is often desirable to use a metal salt such as nickel carbonate and/or ammonium perrhenate and reduce it to a fine metal powder in a hydrogen atmosphere. The metal salt is easily ground to a fine particle size and the particle size will further reduce upon firing in hydrogen. It is often easier to obtain a finer powder in this fasnion than it is starting with the metal powder.

The cathodes of the present invention can be formed by simply compressing a mixture of the powdered emission material and a metal matrix material into a body. This process is typically performed using a compression die and is much simpler than the conventional cathode manufacture in which a melt of the emission material is often required.

In forming the cathode, the emission material preferably has a particles size ranging from 0.01 to greater than 10 microns, and preferably 0.1 to 5 microns. It is mixed with a matrix metal having a particle size which approximately matches the particle size of the emission material. If the matrix metal has a particle size too much larger than the emission material it may seal the cathode and prevent good emission characteristics. In this mix, the emission material (A) and the matrix material (B) are preferably present in a ratio of A:B of 1/10 to 10/1 (by weight). The mixing ratio affects the emission characteristics of the cathode, particularly pulse versus D.C. emission. Higher metal ratios tend to give a higher D.C. to pulsed emission characteristic whereas lower ratios favor the pulse emission characteristic.

The specific compression levels used in making cathodes in accordance with the present invention will vary with the ratio of the emission material to the metal matrix material and the type or types of metals used in the powder mix. Higher compression levels may improve the strength of the cathodes, but, at the same time, may increase the time required to activate the cathode due to the higher compression of the cathode core. It has been found that a cathode fabricated at lower compression levels tends to have a shorter activation time. For a nickel matrix pressures of 8,000 psi to 60,000 psi are suitable. Somewhat higher pressures are required using rhenium or rhenium-titantium-nickel alloy.

A wide variety of topographical and assymetric cathode configurations are possible in the present invention. Some typical cathode configurations that can be made are a free standing button, tubular cathodes, cathodes having a convex, concave, or dimpled surface, etc. The cathode is formed solely from the compressed mixture of emission material and matrix metal. On the other hand, a cathode may include an optional support member. When present, the support member is typically a disc of a metal as disclosed above. It should be realized that the process of the present invention is a convenient means for directly forming a cathode emission layer on a support structure.

The cathode of the present invention can be manufactured using a die press-type arrangement. The compression die used may be either a double-press type die in which both the base and the head are movable, or the type in which the base is stationary. Where a support is used, the support is generally mounted on the lower punch or base and moved into a cavity into which the cathode powders are dispensed. The press head then moves down into the cavity and compresses the powder. Thus, the present invention also provides a cathode manufacture which is free of heating and metal working.

Unlike many conventional thermionic cathodes, the cathode of the present invention is suitable for use in a carbon monoxide or carbon dioxide laser as well as in helium and argon lasers where most conventional cathodes are also suitable. It is impervious to ion bombardment and can be stored under ambient conditions.

While the invention has been described in detail and with reference to specific embodiments thereof, it will be apparent to those skilled in the art that numerous variations and modifications therein are possible without departing from the scope of the following claims.

I claim:

1. A thermionic cathode employing, in a matrix metal, an alkaline earth metal hydroxy oxy carbonate as an emission material, wherein said alkaline earth metal is selected from the group consisting of barium, strontium, calcium and mixtures thereof, said matrix metal is selected from the group consisting of rhenium, nickel, molybdenum, platinum, paladium, ruthenium, iron, tantalum, and alloys thereof, and the weight ratio of said emission material to said matrix metal as in the range of approximately 1/10 to 10/1.

2. The cathode of claim 1 wherein said alkaline earth metal hydroxy oxy carbonate is prepared by dissolving an alkaline earth metal salt in an aqueous solution, neutralizing said solution, driving said solution to a basic condition using hydrogen peroxide, and reacting said solution with carbon dioxide to precipitate said hydroxy oxy carbonate.

3. The cathode of claim 1 wherein said emission material contains barium.

4. The cathode of claim 1 wherein said cathode is formed by compressing a powder mixture of said emission material and said matrix metal.

5. The cathode of claim 4 wherein said cathode additionally comprises a support structure.

6. The cathode of claim 1 wherein said emission material has an operating temperature in the range of 600° C. to 850° C.

7. The cathode of claim 1 wherein said cathode provides an average current density of about 1 to 6 $A/cm_2$ D.C. mode space charge limited operation in the range of about 600° C. to 850° C.

8. A thermionic cathode comprising a compressed mixture of an alkaline earth metal hydroxy oxy carbonate and a matrix metal, wherein said alkaline earth metal is selected from the group consisting of barium, strontium, calcium and mixtures thereof, said matrix metal is selected from the group consisting of rhenium, nickel, molybdenum, platinum, paladium, ruthenium, iron, tantalum, and alloys thereof, and the weight ratio of said emission material to said matrix metal is in the range of approximately 1/10 to 10/1.

9. The cathode of claim 8 wherein said matrix metal is rhenium.

10. The cathode of claim 8 wherein said matrix metal is nickel.

11. The cathode of claim 8 wherein said cathode provides an average current density of about 1 to 6 $A/cm_2$ D.C. mode space charge limited operation in the range of about 600° to 850° C.

12. A process for forming a thermionic cathode which comprises compressing a mixture of an alkaline earth metal hydroxy oxy carbonate and a matrix metal to form a shaped body, wherein said alkaline earth metal is selected from the group consisting of barium, strontium, calcium and mixtures thereof, said matrix metal is selected from the group consisting of rhenium, nickel, molybdenum, platinum, paladium, ruthenium, iron, tantalum, and alloys thereof, and the weight ratio of said emission material to said matrix metal is in the range of approximately 1/10 to 10/1.

13. The process of claim 12 wherein said matrix metal is rhenium or nickel.

14. The cathode of claim 1 wherein said emission material and said matrix metal have a particle size in the range of about 0.01 to 10 microns.

15. The cathode of claim 8 wherein said emission material and said matrix metal have a particle size in the range of about 0.01 to 10 microns.

16. The process of claim 12 wherein said emission material and said matrix metal have a particle size in the range of about 0.01 to 10 microns.

* * * * *

UNITED STATES PATENT AND TRADEMARK OFFICE

CERTIFICATE OF CORRECTION

PATENT NO. : 4,436,651

DATED : March 13, 1984

INVENTOR(S) : David M. Corneille

It is certified that error appears in the above—identified patent and that said Letters Patent is hereby corrected as shown below:

Col. 1, line 17, "surfaces" should be -surface--.

Col. 1, line 20, "an" should be --and--.

Col. 4, line 66, "$X(C_6H_6COO)_2 + H(C_7H_6O_2) + 3NaOH +$" should be --$X(C_6H_5COO)_2 + HClO_4 + 3NaOH$--.

Col. 5, line 55, "have" should be --having--.

Col. 6, line 19, "fasnion" should be --fashion--.

Col. 7, claim 1, line 36, "as" should be --is--.

Signed and Sealed this

*Twenty-third* Day of *October 1984*

[SEAL]

*Attest:*

GERALD J. MOSSINGHOFF

*Attesting Officer*

*Commissioner of Patents and Trademarks*